US009038713B1

(12) United States Patent
Bell et al.

(10) Patent No.: US 9,038,713 B1
(45) Date of Patent: May 26, 2015

(54) SHAPED CHARGE CASING CUTTER

(71) Applicants: William T. Bell, Huntsville, TX (US); James G. Rairigh, Houston, TX (US)

(72) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 0 days.

(21) Appl. No.: 14/120,528

(22) Filed: May 29, 2014

(51) Int. Cl.

| | |
|---|---|
| ***E21B 29/02*** | (2006.01) |
| *E21B 43/117* | (2006.01) |
| *F42B 3/08* | (2006.01) |
| *F42B 1/02* | (2006.01) |

(52) U.S. Cl.
CPC ..... *E21B 29/02* (2013.01); *E21B 43/117* (2013.01); *F42B 3/08* (2013.01); *F42B 1/02* (2013.01)

(58) Field of Classification Search
CPC ..... E21B 29/02; E21B 43/116; E21B 43/117; F42B 1/02; F42B 1/04; F42B 3/08
USPC ..... 102/306, 307, 310, 309; 166/55; 89/1.15
See application file for complete search history.

(56) References Cited

U.S. PATENT DOCUMENTS

| | | | | |
|---|---|---|---|---|
| 3,233,688 | A * | 2/1966 | Bell | 175/4.6 |
| 4,354,433 | A | 10/1982 | Owen | |
| 4,724,105 | A * | 2/1988 | Owen | 264/3.1 |
| 5,046,563 | A * | 9/1991 | Engel et al. | 166/297 |
| 6,016,753 | A * | 1/2000 | Glenn et al. | 102/307 |
| 6,505,559 | B1 * | 1/2003 | Joslin et al. | 102/310 |
| 6,792,866 | B2 | 9/2004 | Grattan | |
| 2006/0075888 | A1 * | 4/2006 | Yang et al. | 89/1.14 |

* cited by examiner

*Primary Examiner* — Robert E Fuller
*Assistant Examiner* — David Carroll

(57) ABSTRACT

A shaped charge casing cutter is constructed with the cutter explosive formed into radial section modules aligned in a toroidal cavity between a pair of housing plates. The center sections of the plates are contiguously aligned with opposite parallel surfaces of a center disc. The plate rims are offset from respective center disc planes in opposite directions from each other to form a toroidal cavity. The toroidal cavity is enclosed by a circumferential belt secured to said plate rims. V-grooved shaped charge explosive in the form of multiple pi sections is distributed about the cavity to intimately contact a pair of frusto-conical liners.

17 Claims, 5 Drawing Sheets

SHAPED CHARGE CASING CUTTER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to shaped charge tools for explosively severing tubular goods including, but not limited to, pipe, tube, casing and/or casing liner.

2. Description of Related Art

The capacity to quickly, reliably and cleanly sever a pipe or well casing deeply within a wellbore is an essential maintenance and salvage operation in the petroleum drilling and exploration industry. Cutting large, 7" to 20" nominal diameter casing and casing liner is particularly challenging. Generally, the industry relies upon mechanical, chemical or pyrotechnic devices for such cutting. Among the available options, shaped charge (SC) explosive cutters are often the simplest, fastest and least expensive tools for cutting pipe in a well. The devices are typically conveyed into a well for detonation on a wireline or length of coiled tubing.

Typical explosive pipe cutting devices comprise a consolidated wheel of explosive material having a V-groove perimeter similar to a V-belt drive sheave. The surfaces of the circular V-groove are clad with a thin metal liner. Pressed contiguously against the metal liner is a highly explosive material such as HMX, RDX or HNS.

This V-grooved wheel of shaped explosive is aligned coaxially within a housing sub and the sub is disposed internally of the pipe that is to be cut. Accordingly, the plane that includes the circular perimeter of the V-groove apex is substantially perpendicular to the pipe axis.

Upon ignition of the explosive, the explosion shock wave reflects off the opposing V surfaces of the grooved wheel to focus onto the respective metal liners. The opposing liners are driven together into a collision that produces a fluidized mass of liner material. Under the propellant influence of the high impingement pressure, this fluidized mass of liner material flows lineally and radially along the apex plane at velocities in the order of 22,000 ft/sec, for example. Resultant impingement pressures against the surrounding pipe wall may be as high as 6 to $7\times10^6$ psi thereby locally fluidizing the pipe wall material.

This principle may be applied to large diameter pipe such as well casing may be cut while positioned within a wellbore with a toroidal circle of explosive having an outside face formed in the signatory V-groove cross-section. This toroidal circle of explosive is placed and detonated within a toroidal cavity of a housing. However, formation of an explosive torroid of sufficient size to sever a large diameter casing requires relatively large quantities of explosive. As an integral unit, such quantities of explosive exceed prudent transportation limitations. For practical reasons of transport and safety, therefore, the mass of the toroidal explosive circle is divided into multiple, small quantity modules of cross-sectional increments which are transported to a well site in separate, isolated packages.

Explosively cutting a 20" casing may require a shaped charge of as much as 600 gm. of hazard class explosive (ex. HMX). However, international standards of transportation safety (United Nations Recommendations on the Transport of Dangerous Goods, Edition 17, Vol. I, Chapter 2.1, Division 1.4) limit the public transport of a single unit of hazard class explosive to 38 gm. Consequently, to transport a shaped charge cutter of size sufficient to cut a 20" casing, it is essential for the explosive elements of the cutter to be designed for shipment as a multiplicity of small, less than 38 gm/unit, modules configured for operational assembly at the point of use.

Unfortunately, the environmental circumstances of a drilling rig floor, which is where final cutter assembly must occur, are often severe and usually not conducive to the attentive care required for final assembly of a high explosive tool. Hence, there are strong incentives to design the individual explosive modules with the greatest degree of assembly tolerance. But large module assembly tolerance often results in collective space between modules. In the case of modular assembly for shaped charges, such assembly space can severely diminish the cutter capacity.

Other issues for large diameter casing cutters arise with deep wells under considerable hydrostatic pressure. Large surface areas for prior art casing cutter housings may be distorted under deep well fluid pressure, also resulting in reduced cutting capacity.

BRIEF SUMMARY OF THE INVENTION

The present casing cutter invention comprises several design and fabrication advantages including a substantially solid structural interior that is substantially impervious to well depth pressure. Shaped charge explosive material is distributed in modules around the full circle of an approximately toroidal cavity that is held open against well pressure by a full-circle belting structure.

Preferably, the modules are further divided into smaller units corresponding to upper and lower half sections of an approximate toroid. The shaped charge metal liner is independently fabricated as a pair of matching cone frustums.

Collective tolerance space between the modules and modular units of explosive material is closed around the toroid circumference by paper card stock shims between adjacent explosive modules.

The back-side surfaces of the shaped charge assembly may be resiliently biased into intimate contact against the liner cone surfaces by an O-ring springs bearing upon the explosive module back-sides. A gap between the adjacent apex surfaces of the modules accommodates module fabrication tolerances.

BRIEF DESCRIPTION OF THE SEVERAL VIEWS OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF THE INVENTION

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
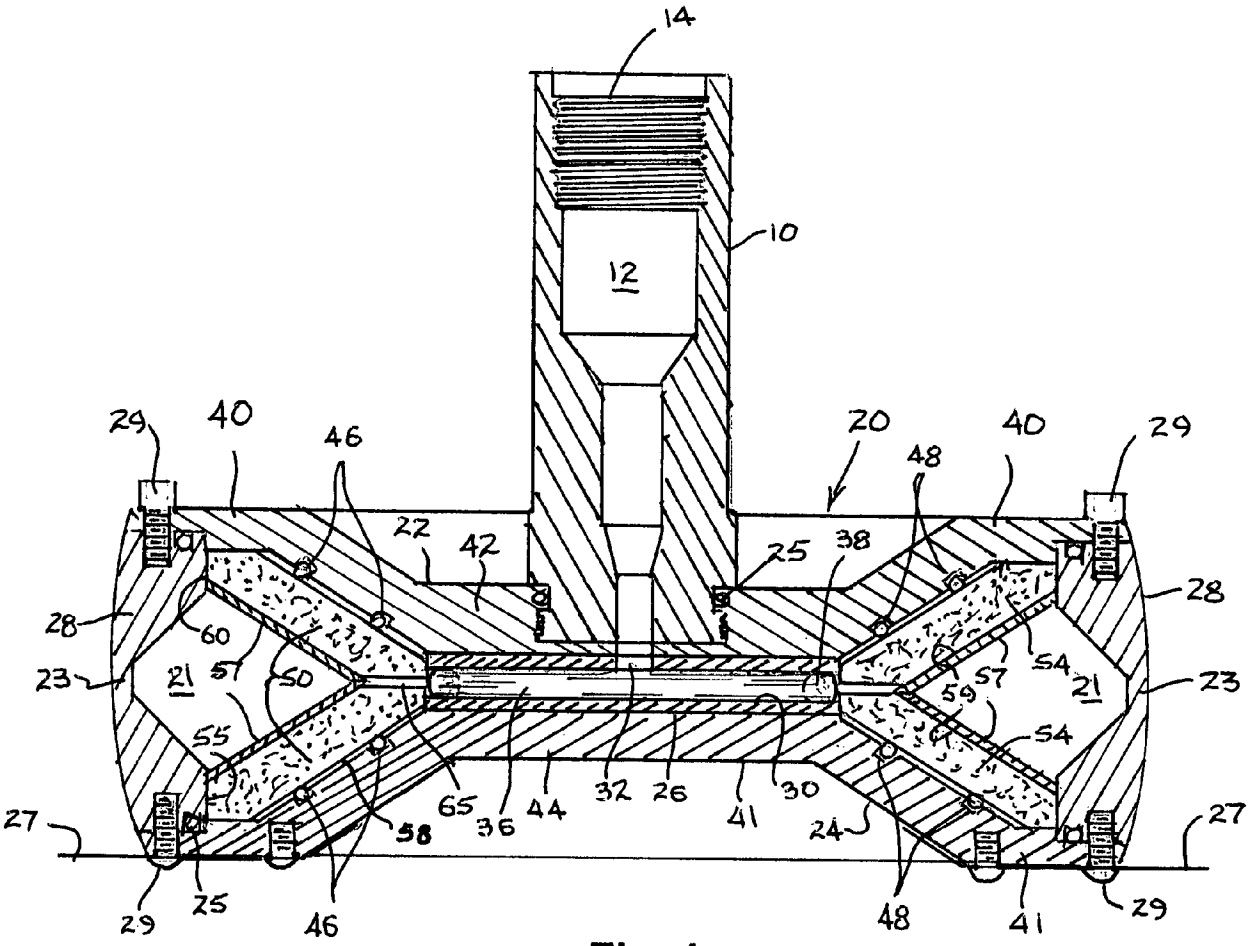
FIG. 1 is a cross-section of a preferred embodiment of the invention in assembly with the housing, centralizer and connecting sub.

Referring to FIG. 1, a detonator sub body 10 is formed with an axial cavity 12 for receipt of a detonator sub-assembly not shown. Internal threads 14 proximate of the sub body upper end provide a convenient mechanism for securing the sub body to a tubing string, for example. External threads 16 at the lower end of the sub body secure the sub body to the upper housing plate 22 of the shaped charge housing 20.

The shaped charge housing 20 assembly basically comprises four major components. Upper and lower housing plates 22 and 24 are separated by spacer plate 26. The housing plates and spacer plate are all of substantially circular perimeter. A belting ring 28 secures the assembly with a plurality of threaded fasteners 29. Notably, the belting ring fit with the housing plate perimeters is designed to oppose distortions and closure of the toroidal cavity 21 between the plate perimeters due to high external fluid pressure. O-ring seals 25 environmentally secure the toroidal cavity 21 around the housing perimeter inside of the belting ring. The belting ring Outside diameter is only slightly less than the inside diameter of the casing that is to be severed. Centering springs 27 may be secured to the housing to project radially outward by a predetermined distance determined by the internal diameter of the severed casing.

The belting ring 28 thickness is notched about its internal perimeter to provide a narrow penetration band 23 in the radial expansion plane of the shaped charge cutting jet.

Figure 3:
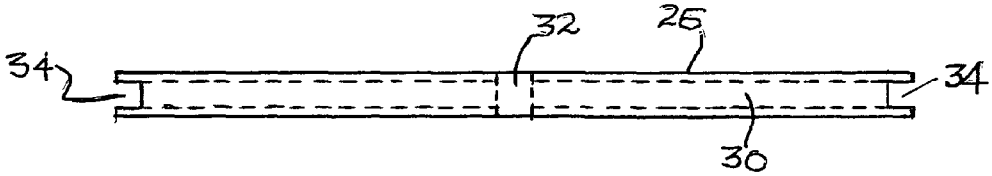
FIG. 3 is an elevation view of the spacer plate.
Figure 2:
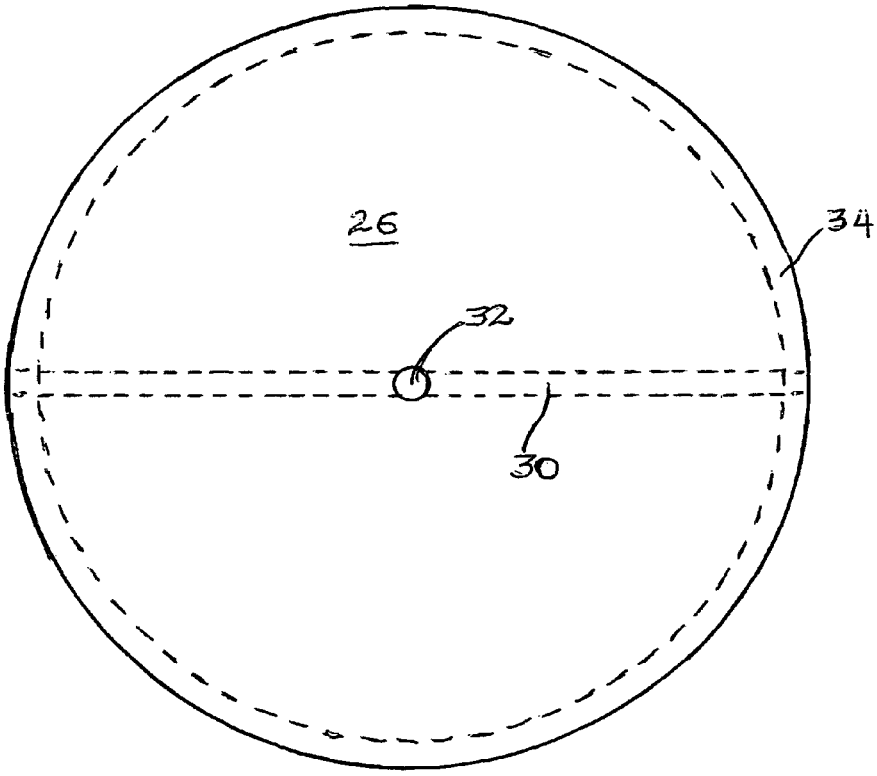
FIG. 2 is a plan view of the spacer plate.

Referring to FIGS. 2 and 3, the spacer plate 26 may be a substantially solid disc having parallel face planes and at least one transverse detonator cord boring 30 between the face planes that is intersected at the disc center by a detonator aperture 32. The perimeter of the disc is channeled by a detonator cord confining groove 34. Preferably, the transverse detonator cord 36 is continuous between opposite outer perimeters of the spacer plate for termination at close adjacency against adjacent explosive units 54. The two arcuate cord portions 38 that form a detonating circle have respective opposite distal ends that terminate against side elements of the transverse cord.

Figure 4:
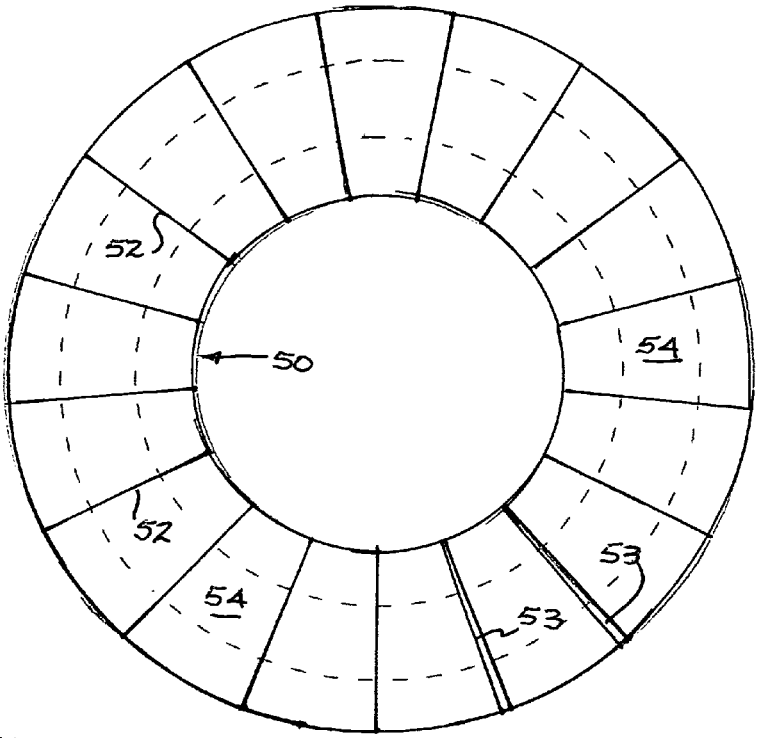
FIG. 4 is a plan view of the explosive assembly.
Figure 5:
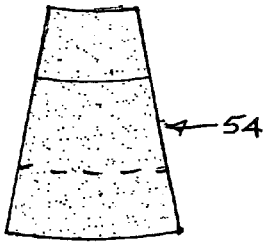
FIG. 5 is a plan view of an individual explosive unit.
Figure 6:
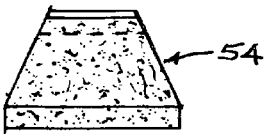
FIG. 6 is an end elevation view of an individual explosive unit.
Figure 7:
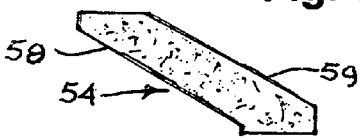
FIG. 7 is a side elevation view of an individual explosive unit.

With further reference to FIG. 1, the upper and lower housing plates 22 and 24 are formed to substantially the same profile. The annular rims 40 and 41 of the respective housing plates 22 and 24 are substantially concentric with corresponding center sections 42 and 44. The annular rim plane 40 of the upper plate 22 is offset from and in parallel alignment with the plane of the circular plate center section 42. As a mirror reflection, the annular rim 41 of the lower housing plate 24 is offset from and in parallel with the plane of the circular plate center section 44, An approximately toroidal cavity 21 is formed within the interior surfaces of the plate rims and the belting ring to confine a circular assembly of explosive modules 50. Each module 50 is a radial increment of a shaped charge circle. The plan view of FIG. 4 illustrates the circular alignment of the modules 50 with juxtaposed radial joint planes 52. Each module 50 comprises a matching pair of explosive units 54, with no unit exceeding 38 gm. of explosive, for example. The three orthographic views of FIGS. 5, 6 and 7 show a single unit 54 having a body 56 of compressed, high explosive material.

As the individual units are positioned against a respective housing plate interior surface 49 in the circle illustrated by FIG. 4, it will be understood that each unit must be formed to a small undersize tolerance for assembly convenience. When all of the units are positioned and pressed together, collectively, this necessary tolerance is accumulated as an intolerable space between the first and last units that may be 0.010" or more. Leaving such a space may severely influence the shaped charge performance. An unfilled inter-unit space of 0.0625" has been measured to reduce cutting penetration by half. Of course, this space may be packed with loose explosive but such a solution is not only time consuming but hazardous.

Filling the spaces with metallic shims has also been found to be unsatisfactory. Cutting performance is nevertheless reduced. Surprisingly, it has been found that the spaces may be filled with "card stock" paper shims 53 without measureable loss of cutting penetration. Typical specifications for card stock paper includes a paper sheet that is calendared to an approximate density range of 135 to 300 g/m$^2$ and thickness range of 0.01 in. to 0.015 in. In practice, the card stock shim is cut into the section shape of an explosive unit as shown by FIG. 7 and inserted in the space between adjacent explosive units 54. Preferably, only one card stock shim is positioned between an adjacent pair of explosive units 54. Collective spaces greater than a single card stock thickness may be closed by inserts between multiple pairs of explosive units and/or modules.

It has long been believed that intimate contact of the shaped charge explosive material with the interior surface 49 of the housing structure enhanced the cutting energy release. U.S. Pat. No. 6,505,559 to J. Joslin et al assumed this relationship by their disclosed use of "glue" to secure segmented explosive units to a backing plate. However, when practiced in the environment of a drilling rig floor, the difficulties of gluing explosive units in place are numerous. Moreover, Applicants have discovered the intimate relationship to be less critical than originally believed.

Of far greater importance is the intimate relationship of the explosive with the contiguous liner. In the prior art fabrication process, the independently formed metallic liner is placed in a molding receptacle and powdered explosive distributed over the liner. Subsequently, a forming die is forced against the powdered explosive to compact it against the liner surface and adhere it intimately thereto.

The present invention procedure calls for a partial assembly of the shaped charge housing 20 by attaching the belting ring 28 to the lower housing plate 24 by means of fasteners 29. Additionally, the spacer plate 26 is centered upon the lower plate center section 44. This provides an open but walled circular channel within the belting ring interior perimeter. Within this circular channel, the appropriate number of explosive units 54 are positioned with the outer end face 55 of each explosive unit placed contiguously against the inner face 60 of the belting ring 28 while the inner end face of the explosive units 54 is positioned adjacent to the center section 44 outer perimeter. The outer face 58 of each explosive, unit 54 is supported by two or more O-rings 46. Contiguous continuity between the several units 54 about the module 50 circle is completed by inserting a required number of shims 53 between one or more pairs of units 54. Upon this assembly of explosive units 54, the conical frustum 57 of a first liner half is placed against the inner face 59 of the explosive units.

Figure 8:
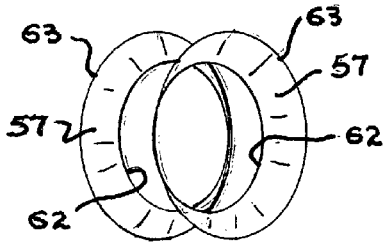
FIG. 8 is a pictorial view of the metallic liners

Alignment of the upper half of the cutter ring onto the previously assembled lower half begins with positioning the minor diameter edge 62 of the upper frustum 57 against the minor diameter edge 62 of the lower frustum 57. See FIG. 8. If correctly dimensioned, the major diameter edge 63 of the upper frustum will be contiguously confined against the upper inside face 60 of the belting ring 28. The upper layer of explosive units 54 are placed upon the upper liner frustum with contiguous fits against the belting ring and spacer plate 26 outer perimeter. A sufficient number of shims 53 are positioned between adjacent pairs of explosive units 54 to complete the contiguous continuity.

When the shaped charge housing assembly 20 is completed by securing the upper housing plate 22 to the belting ring 28, the upper and lower plate O-rings 48 exert a mutually opposed bias upon the explosive units 54 and the respective frustums 57.

It is important to note that the explosive unit 54 dimensions described above provide an open space 65 between the proximate explosive units 54 to accommodate other dimensional tolerance variations. In view of the tightly confined environment of Applicant's explosive cutter assembly and the consequential fluctuations of manufacturing tolerances, a free movement space for the units 54 is essential to assure intimate contact with the liner frustums 57. Although paper shims 53 successfully fill the circumferential tolerance space between adjacent explosive units 54, it is the resilient bias of the O-rings 46 that press the units 54 into necessary intimate contact with the liner material 57.

Figure 9:
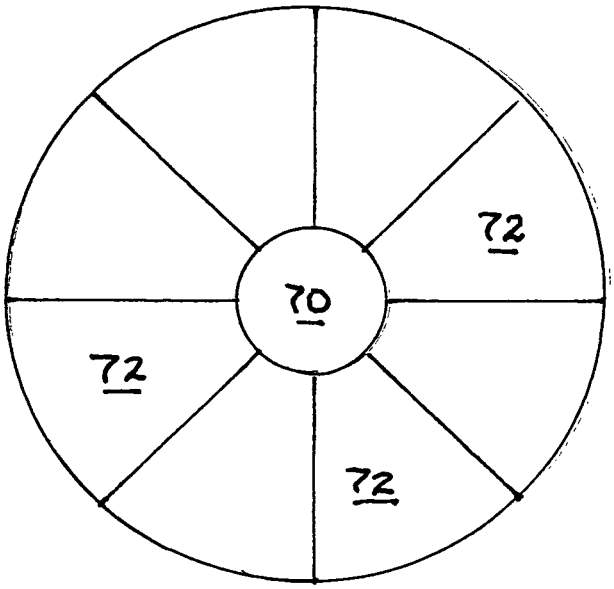
FIG. 9 is a plan view of an alternate detonator charge assembly.

FIG. 9 illustrates an alternative embodiment of the invention ignition system in which the spacer plate 26 is replaced by a solid layer of explosive detonation material. However, the explosive material layer is divided into increments, none of which exceed regulatory and safety limits. For example, FIG. 9 shows a central disc 70 of compressed detonation material positioned centrally adjacent the initiator not shown. Surrounding the central disc 70 are a plurality of detonation material increments compressed into pi segments 72 having radial continuity between the outer perimeter of the central disc 70 to the inner perimeter of the shaped charge modules 50.

Figure 10:
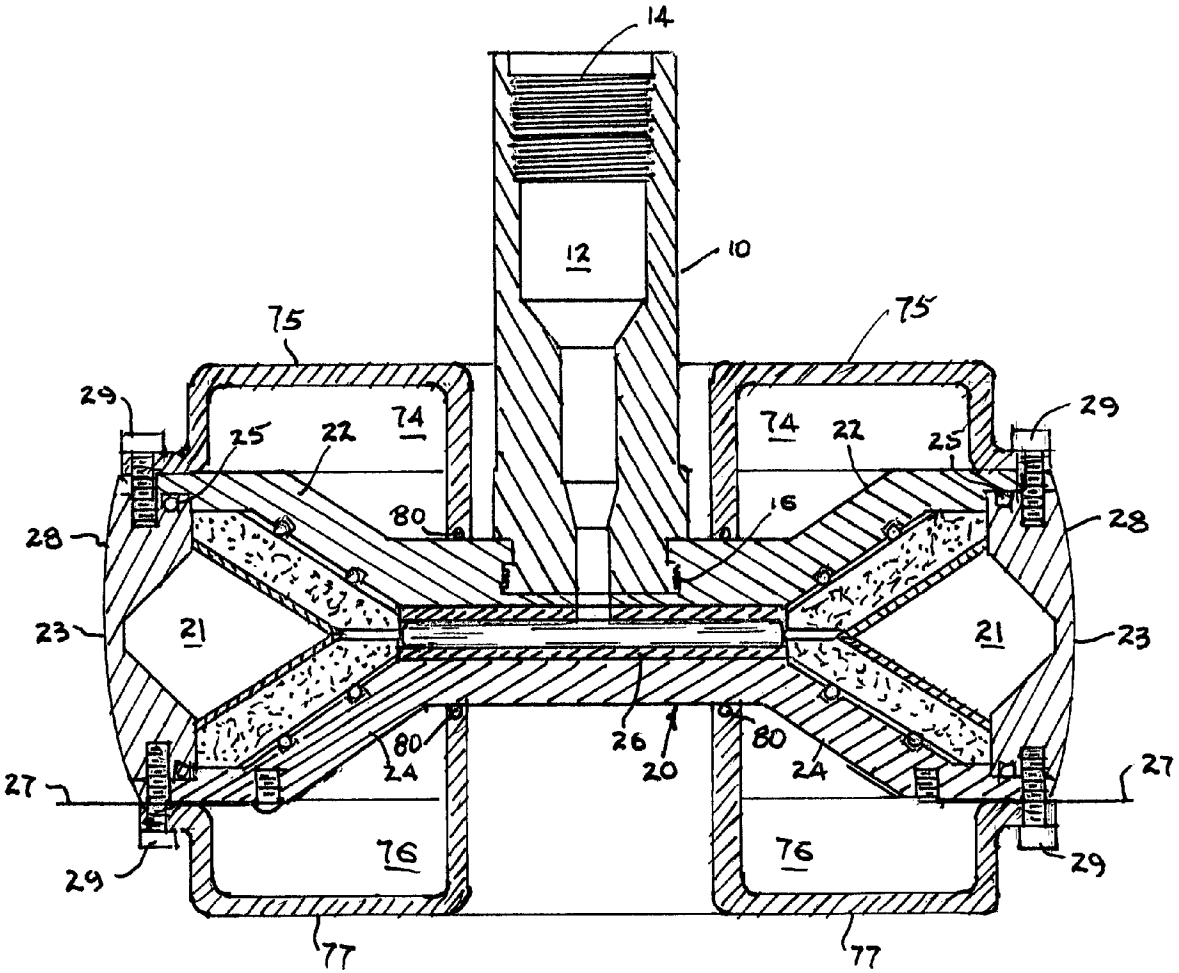
FIG. 10 is a cross-section of the invention provided with buffer chambers.

As a further invention enhancement, FIG. 10 illustrates the invention housing as including buffer chambers 74 and 76 within annular channels 75 and 79. O-rings 80 and 82 seal the respective chamber volumes from the downhole fluid environment. The function of these annular channels and buffer chambers is to absorb and suppress energy reflections from the housing plates 22 and 24. Unbuffered, such reflected energy tends to disrupt the planar uniformity of the cutting disc as it erupts from the liner apex. A disturbed cutting disc results in a flared wall cut and an enlarged perimeter of "flash" on the pipe wall about the cutting plane.

While a preferred embodiment of our invention has been illustrated in the accompanying drawings and described in the foregoing specification, it will be understood by those of skill in the art that additional embodiments, modifications and alterations may be constructed from the invention principles disclosed herein. These various embodiments have been described herein with respect to cutting a "pipe." Clearly, other embodiments of the cutter of the present invention may be employed for cutting any tubular good including, but not limited to, pipe, tubing, production/casing liner and/or casing. Accordingly, use of the term "tubular" in the following claims is defined to include and encompass all forms of pipe, tube, tubing, casing, liner, and similar mechanical elements.

Having thus described the preferred embodiments, the invention is claimed as follows:

1. A shaped charge pipe cutter comprising:

first and second substantially circular housing plates, each having a planar rim and planar center section aligned about a common axis, the respective planes of said rim and center section having substantially parallel offsets;

a substantially planar center disc having a perimeter channel for confining detonation cord between opposite parallel face planes, at least one transverse aperture through said disc between said face planes, explosive material disposed within said transverse aperture between opposite junction points with said perimeter channel, a detonator aperture intersecting said transverse aperture along said common axis;

the respective housing plate center sections aligned contiguously against respective center disc faces with oppositely directed rim offsets to form a substantially toroidal cavity between said rims;

a circumferential belting ring secured to said planar rims to maintain a parallel alignment between said planar rims; and a shaped charge explosive disposed within said substantially toroidal cavity to discharge a substantially radial cutting jet through said belting means.

2. A shaped charge pipe cutter as described by claim 1, wherein said circumferential belting ring includes a circumferential cutting jet penetration band of reduced radial thickness.

3. A shaped charge pipe cutter as described by claim 1, wherein a detonator sub is secured to said first substantially circular housing plate with an axis of said detonator sub aligned substantially normal to the plane of said first substantially circular housing plate.

4. A shaped charge pipe cutter as described by claim 1, wherein an O-ring is secured about a surface of said first substantially circular housing plate within said substantially toroidal cavity to bear resiliently upon said explosive means.

5. A shaped charge pipe cutter as described by claim 1, wherein said shaped charge explosive comprises a plurality of shaped charge module units.

6. A shaped charge pipe cutter as described by claim 5, wherein each of the plurality of shaped charge module units comprises a radial increment of a toroid a having substantially juxtaposed radial side planes.

7. A shaped charge pipe cutter as described by claim 6, wherein a plurality of tolerance spaces between adjacent module unit radial side planes are filled with a shim of paper card stock.

8. A shaped charge pipe cutter as described by claim 6, wherein each of the plurality of shaped charge module units comprises a pair of half modules respectively confined adjacent the first and second housing plates.

9. A shaped charge pipe cutter as described by claim 8 wherein residual tolerance space between at least a pair of adjacent module unit radial side planes is filled with a shim of paper card stock.

10. A shaped charge pipe cutter as described by claim 8 wherein an O-ring is secured about a surface of said first housing plate within said toroidal cavity to bear resiliently upon said module units.

11. A shaped charge casing cutter comprising:

a pair of substantially circular housing plates, each plate having a rim in a first plane and a center section in a second plane, the respective planes of said rim and center section being substantially parallel and offset from each other;

a substantially planar center disc having opposite parallel face planes, a perimeter channel between said face planes for confining a circumferential detonation cord, an aperture through said disc between said face planes and between a pair of junction points with said perimeter channel, said aperture for receipt of explosive material a detonator aperture penetrating said disc substantially normal to a disc face plane along an axis common to said pair of substantially circular housing plates and center disc;

the center section of each substantially circular housing plate aligned contiguously against respectively opposite substantially planar center disc faces with said rims offset in opposite directions to form a substantially toroidal cavity between said rims;

a circumferential belt secured to said rims of each substantially circular housing plate to complete an enclosure of said substantially toroidal cavity and maintain a parallel alignment between said rims; and a shaped charge explosive disposed within said substantially toroidal cavity to discharge a substantially radial cutting jet through said circumferential belt.

12. A shaped charge casing cutter as described by claim 11, having a circle of resilient bias material within said substantially toroidal cavity secured to a surface of one of said pair of substantially circular housing plates between said center disc perimeter channel and the rim of one of said pair of substantially circular housing plates to bias said shaped charge explosive against a surface of the other of said pair of substantially circular housing plates.

13. A shaped charge casing cutter as described by claim 11, having an O-ring secured to a surface of one of said pair of substantially circular housing plates between said center disc perimeter channel and the respective housing plate rim and within said substantially toroidal cavity to resiliently bias said shaped charge explosive.

14. A shaped charge casing cutter as described by claim 11 wherein said shaped charge explosive has a toroid shape to conform with said substantially toroidal cavity, the toroid shape being divided into a plurality of radial segments.

15. A shaped charge casing cutter as described by claim 14, wherein no segment of said plurality of radial segments includes no more than 38 gm. explosive.

16. A shaped charge casing cutter as described by claim 14, wherein said plurality of radial segments are joined at juxtaposed radial planes.

17. A shaped charge casing cutter as described by claim 16, wherein spaces between adjacent radial segments are substantially filled with a shim of paper card stock.

* * * * *